US007059051B2

(12) United States Patent
Reich et al.

(10) Patent No.: US 7,059,051 B2
(45) Date of Patent: Jun. 13, 2006

(54) FLUTED ROLL AND METHOD FOR THE MANUFACTURE THEREOF

(75) Inventors: Heribert Reich, Weiherhammer (DE); Alfons Gnan, Vilseck (DE); Thomas Kamm, Grafenwohr (DE); Edmund Bradatsch, Weiden (DE); Norbert Stadele, Weiden (DE)

(73) Assignee: BHS Corrugated Maschinen- und Anlagebau GmbH, Weiherhammer (DE)

( * ) Notice: Subject to any disclaimer, the term of this patent is extended or adjusted under 35 U.S.C. 154(b) by 100 days.

(21) Appl. No.: 10/617,305

(22) Filed: Jul. 11, 2003

(65) Prior Publication Data

US 2004/0009861 A1 Jan. 15, 2004

(30) Foreign Application Priority Data

Jul. 11, 2002 (EP) ..... 02 015 396

(51) Int. Cl.
*B21D 53/00* (2006.01)

(52) U.S. Cl. ..... 29/895.31; 492/36

(58) Field of Classification Search ..... 492/36; 29/895.3, 895.31

See application file for complete search history.

(56) References Cited

U.S. PATENT DOCUMENTS 1,589,584 A * 6/1926 Campbell ..... 29/895.31
1,704,192 A * 3/1929 Hoagland ..... 407/114
1,887,510 A * 11/1932 Honeycutt et al. ..... 72/220
2,206,492 A 7/1940 Westenberger et al.
3,919,029 A * 11/1975 Osgood ..... 156/205
3,990,935 A 11/1976 Lehmann
4,531,996 A * 7/1985 Sukenik ..... 156/472
4,548,000 A * 10/1985 Junker ..... 451/48
5,582,874 A * 12/1996 Hyde ..... 427/451
2002/0115545 A1* 8/2002 Yoshida et al. ..... 492/30

FOREIGN PATENT DOCUMENTS

DE 100 34 780 3/2001
EP 0 943 424 9/1999

OTHER PUBLICATIONS

Patent Abstracts of Japan, Umetani Seisakusho:KK, Groove Processing Method to Hard Material, "Goove Processing Method to Hard Material", Jul. 14, 1989.

* cited by examiner

*Primary Examiner*—Marc Jimenez
(74) *Attorney, Agent, or Firm*—Browdy and Neimark, PLLC

(57) ABSTRACT

A method of manufacturing fluted rolls, in particular for corrugating machines, comprises the steps of providing a fluted-roll blank which has a central longitudinal axis and a longitudinal direction that is parallel thereto and a surface; providing a grinding device for grinding, on the surface, flutings that run in the longitudinal direction, with the flutings comprising heads and roots that are parallel to each other and are regularly and alternately distributed along the circumference of the surface; and grinding fluting heads on the surface by means of the grinding device, with the fluting heads having the same cross-sectional curvature in the longitudinal direction.

18 Claims, 12 Drawing Sheets

FLUTED ROLL AND METHOD FOR THE MANUFACTURE THEREOF

BACKGROUND OF THE INVENTION

1. Field of the Invention

The invention relates to a fluted roll, in particular for corrugating machines, and a method for the manufacture thereof.

2. Background Art

In the manufacture of corrugated board, pairs of fluted rolls are used for producing a corrugated medium from a smooth paper sheet, as described for instance in U.S. Ser. No. 09/667,713. For the nip pressure to be maintained between two fluted rolls of major width, one of the fluted rolls, in practice, is provided with a swell i.e., the roll is bomb shaped, having a diameter that grows continuously from both ends towards the middle. In the case of pairs of fluted rolls with at least one fluted roll having a swell, paper infeed has been observed to be irregular, causing creases during the manufacture of corrugated board.

SUMMARY OF THE INVENTION

It is an object of the invention to embody a fluted roll and a method for the manufacture thereof in such a way that paper infeed is as uniform as possible in the contact area between two fluted rolls.

This object is attained by features which consist in providing a fluted-roll blank which has a central longitudinal axis and a longitudinal direction that is parallel thereto and a surface; and in providing a grinding device for grinding, on the surface, flutings that run in the longitudinal direction; with the flutings comprising fluting heads and roots that are parallel to each other and are regularly and alternately distributed along the circumference of the surface; and in grinding fluting heads on the surface by means of the grinding device, the fluting heads having the same cross-sectional curvature in the longitudinal direction. Furthermore, this object is attained in a fluted roll comprising a fluted-roll basic body which has a central longitudinal axis and a longitudinal direction parallel thereto and a surface; and flutings which are provided on the surface and regularly distributed along the circumference thereof and which run in the longitudinal direction, with the flutings comprising fluting heads that project radially and roots that stand back radially, the heads and roots being parallel to each other and alternating; wherein the fluting heads have the same cross-sectional curvature in the longitudinal direction. The gist of the invention resides in embodying a fluted roll such that the curving behaviour of the fluting heads is uniform over the entire width of the fluted roll—even if it is bomb shaped. This means that the outer contour of the fluting heads, and possibly also parts of the flanks of a fluting that adjoins the fluting heads, are shaped identically even in the case of swell.

Additional features and details of the invention will become apparent from the ensuing description of an exemplary embodiment, taken in conjunction with the drawings.

DESCRIPTION OF A PREFERRED EMBODIMENT

Figure 1:
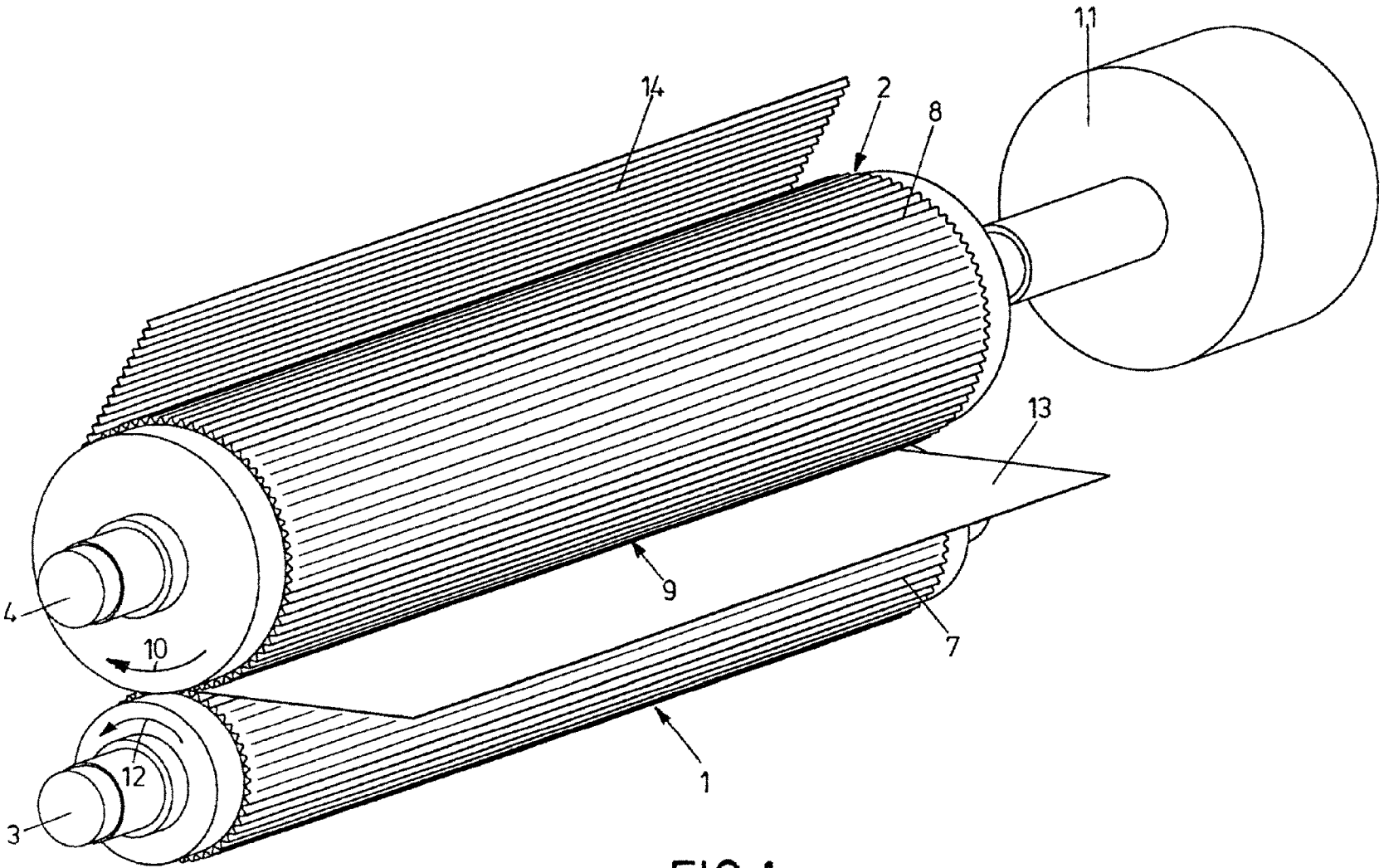
FIG. 1 is an illustration of a pair of fluted rolls of a machine according to the invention for the manufacture of corrugated board.

The basic structure of a machine for the manufacture of corrugated board is described in U.S. Ser. No. 09/667,713, in particular FIG. 1, to which reference is made. The machine for the manufacture of corrugated board comprises a lower fluted roll 1 and an upper fluted roll 2. At their ends, the fluted rolls 1 and 2 have projecting shafts 3 and 4 with associated parallel axes of rotation 5 and 6. Their cylindrical surfaces are provided with flutings 7 and 8 which are parallel to the axes 5, 6 and mesh in an area of contact 9. The upper fluted roll 2 is driven in a direction of rotation 10 by a drive 11, while the lower fluted roll 1 is moved along in a direction or rotation 12. A paper sheet 13 is fed into the area of contact 9; it is shaped into a corrugated medium 14 by the flutings 7, 8. Downstream of the area of contact 9 in the direction of rotation 10 and 12, provision is made for a gluing device, details of which are described in U.S. Ser. No. 09/667,713, gluing the tips of the corrugated medium 14, and for a contact pressure device, pressing a liner sheet against the corrugated medium 14 which is provided with glue.

Figure 2:
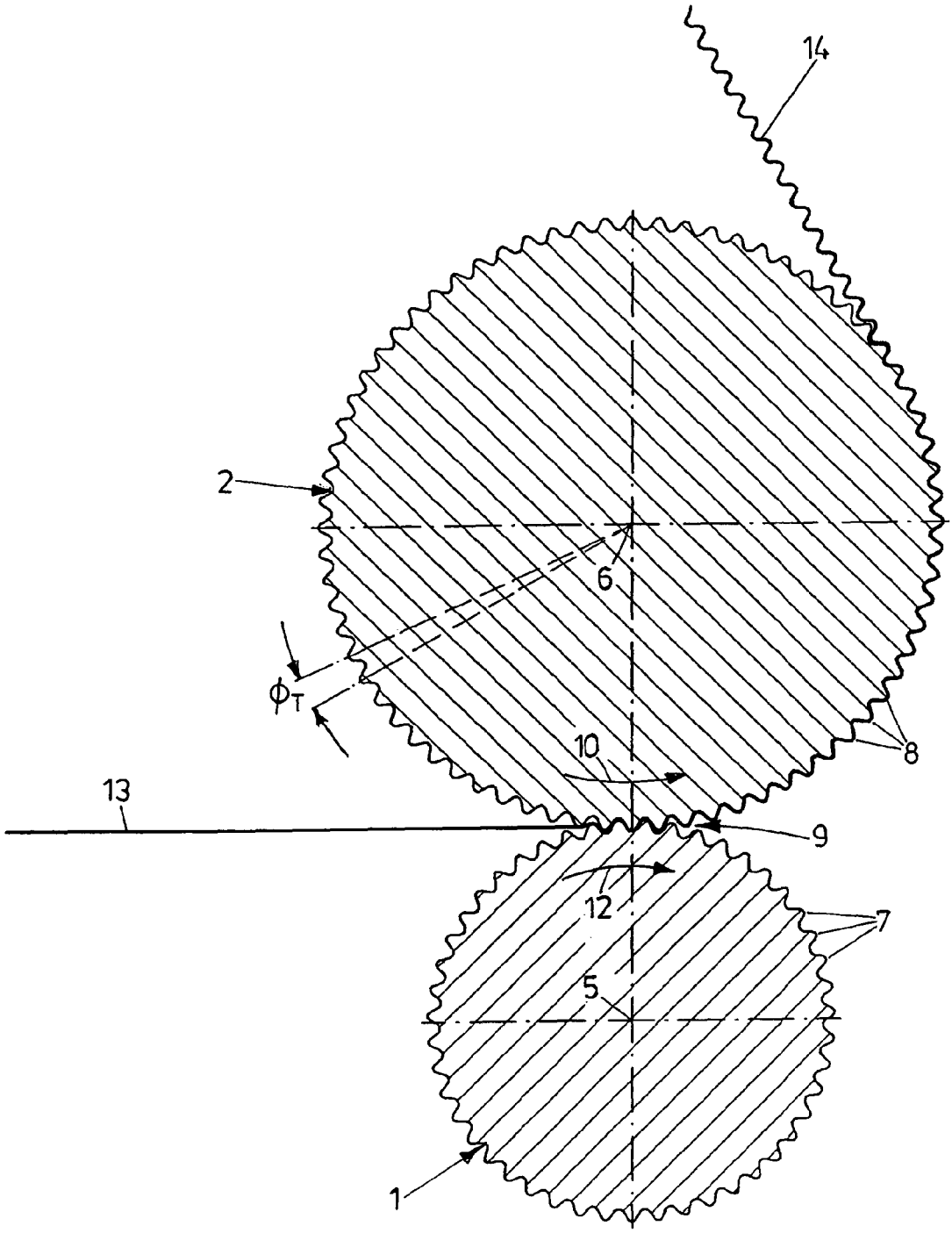
FIG. 2 is a cross-sectional view of the fluted rolls according to FIG. 1.
Figure 4:
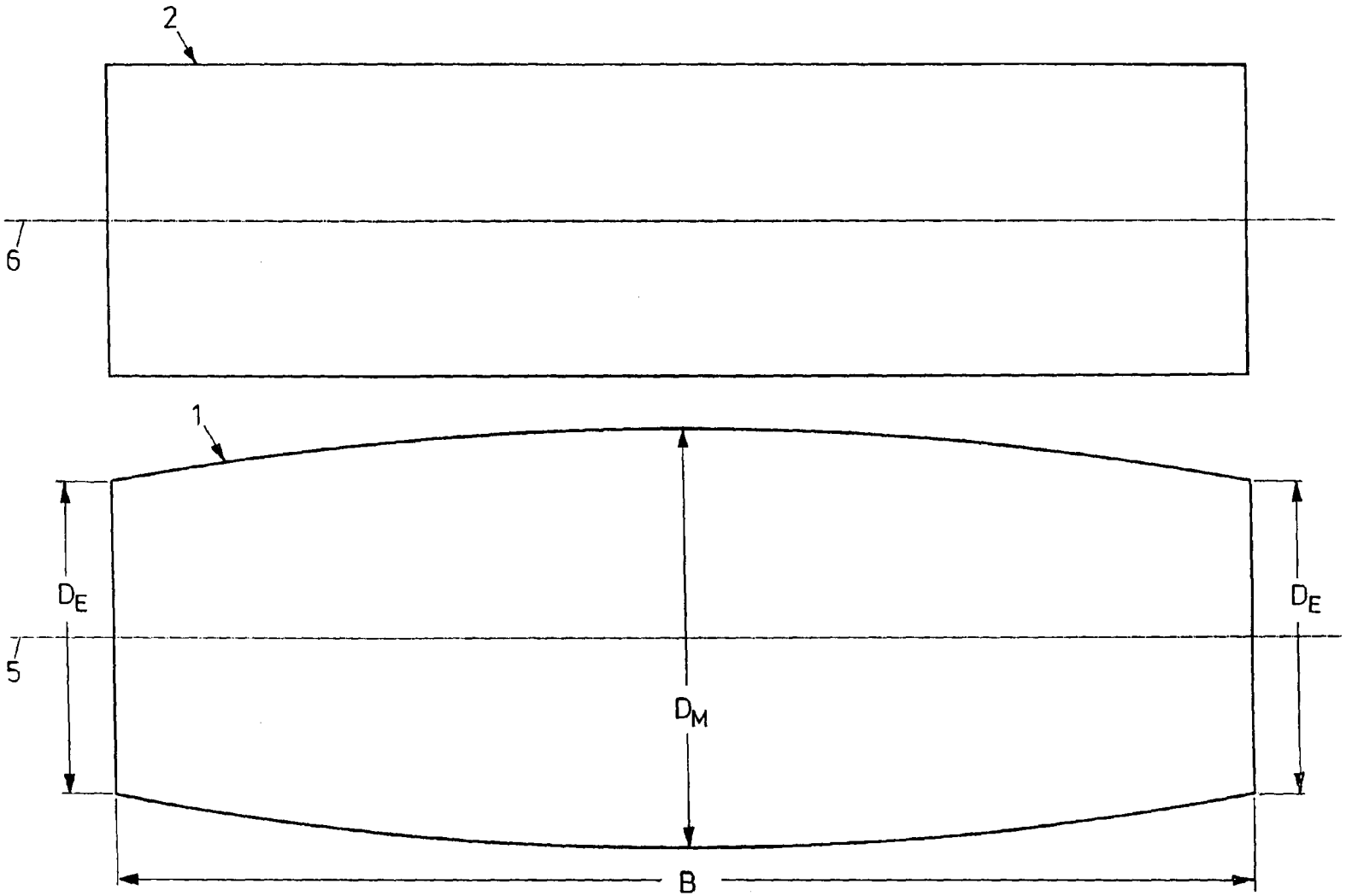
FIG. 4 is a view of a pair of fluted rolls with one fluted roll having a swell which is not illustrated true to scale.

As known for example from U.S. Ser. No. 09/667,713, FIG. 2, the fluted rolls 1 and 2 can be pressed together for a predetermined nip pressure of greatest possible uniformity over the width of the fluted roll to be produced in the contact area 9. Due to the dead weight and the resulting sag, fluted rolls of a certain width will no longer be able to reach a predetermined nip pressure by the bearings of the shafts 3 and 4 being pressed together. Therefore, at least one of the two fluted rolls 1, 2—in the present 5 case the lower fluted roll 1—is provided with a swell i.e., it is bomb shaped. This means that the diameter of the fluted roll 1 continuously augments from the two ends towards the middle. Given a width of the fluted roll 1 of B=3.30 m, a swell of approximately 4 mm will result from the difference of the diameter $D_M$ in the middle of the fluted roll 1 from the diameter $D_E$ at the end of the fluted roll 1. This means that the circumference of the fluted roll 1 in the middle is greater by approximately $2\pi(D_M-D_E)/2\cong 12.6$ mm. The difference of the cylindrical fluted roll 2 from the bomb-shaped fluted roll 1 is not true to scale in FIG. 4.

Figure 5:
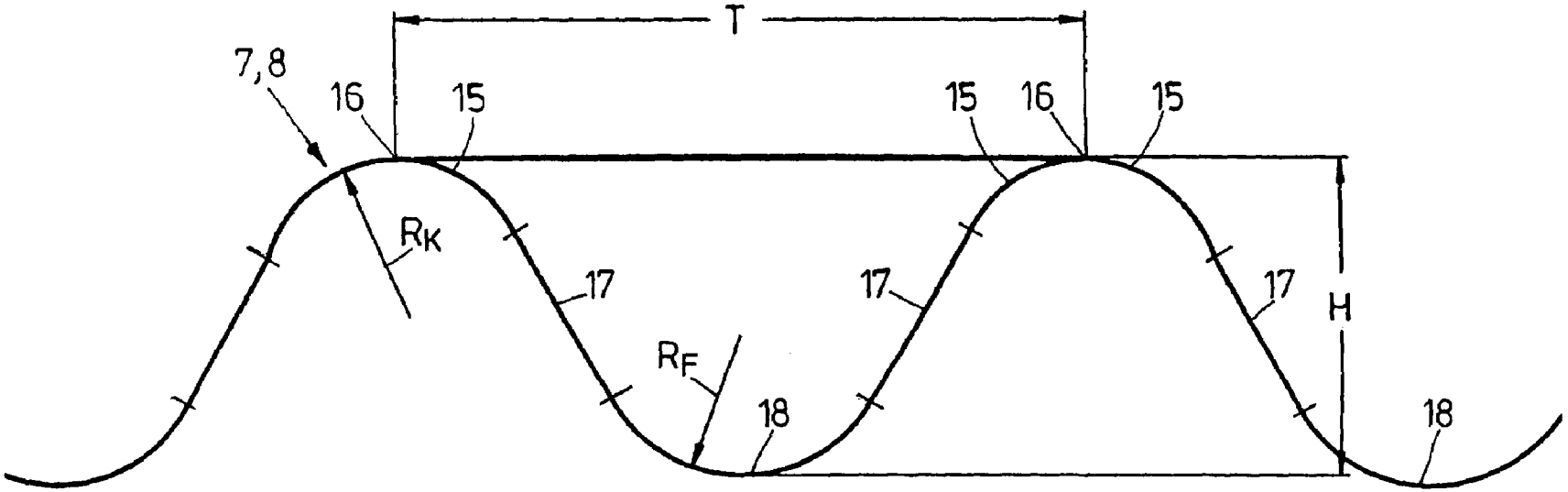
FIG. 5 is an illustration of the ideal course of the flutings of a fluted roll.

FIG. 5 illustrates details of the ideal course of the flutings 7 and 8. Each fluting 7, 8 has a radially projecting head 15 of predetermined constant curvature with a radius of curvature $R_K$, which is illustrated in a cross-sectional view in FIG. 5. The curvature of the fluting head 15 is convex, related to the axes of rotation 5 and 6. At its highest point, the fluting head 15 has a crest 16. Each fluting head 15 is mirror symmetrical in relation to a plane of symmetry, with a respective crest 16 and a respective axis of rotation 5, 6 defining that plane of symmetry. Each fluting head 15 is bilaterally defined by a substantially straight flank 17 that reaches approximately from the end of the upper quarter of the height H of the fluting as far as to where the lower quarter of H starts. The flanks 17 are adjoined by a root 18 which is concave, related to the axes of rotation 5 and 6. The root 18 has a predetermined constant curvature of a radius of curvature $R_F$. The radius of curvature $R_K$ is less than the radius of curvature $R_F$. This is due to the fact that a gap for accommodation of the corrugated medium 14 must remain between a fluting head 15 of a fluted roll and a root 18 of another fluted roll. The difference of $R_F$ from $R_K$ depends on the thickness and type of paper and on other parameters; it frequently ranges between 0.1 and 0.8 mm, in particular between 0.28 mm and 0.51 mm. The flutings 7, 8 are parallel to each other, extending over the width of the fluted rolls 1 and 2 in parallel to the axes of rotation 5 and 6 thereof. Furthermore, the flutings 7, 8 are distributed regularly along the circumference of the surfaces of the fluted rolls 1 and 2. The distance of neighboring fluting heads 15 is termed the spacing T. Allocated to each spacing T is an angular pitch $\phi_T$ made by neighboring fluting heads 15 in relation to the respective axis of rotation 5 and 6. In the case of the fluted rolls 1 and 2, the angular pitch $\phi_T$ is constant, with the angular pitch of the fluted roll 1 not necessarily being equal to the angular pitch of the fluted roll 2. The design of the flutings 7, 8 seen in FIG. 5 corresponds to the ideal course in a cylindrical roll without swell.

Figure 3:
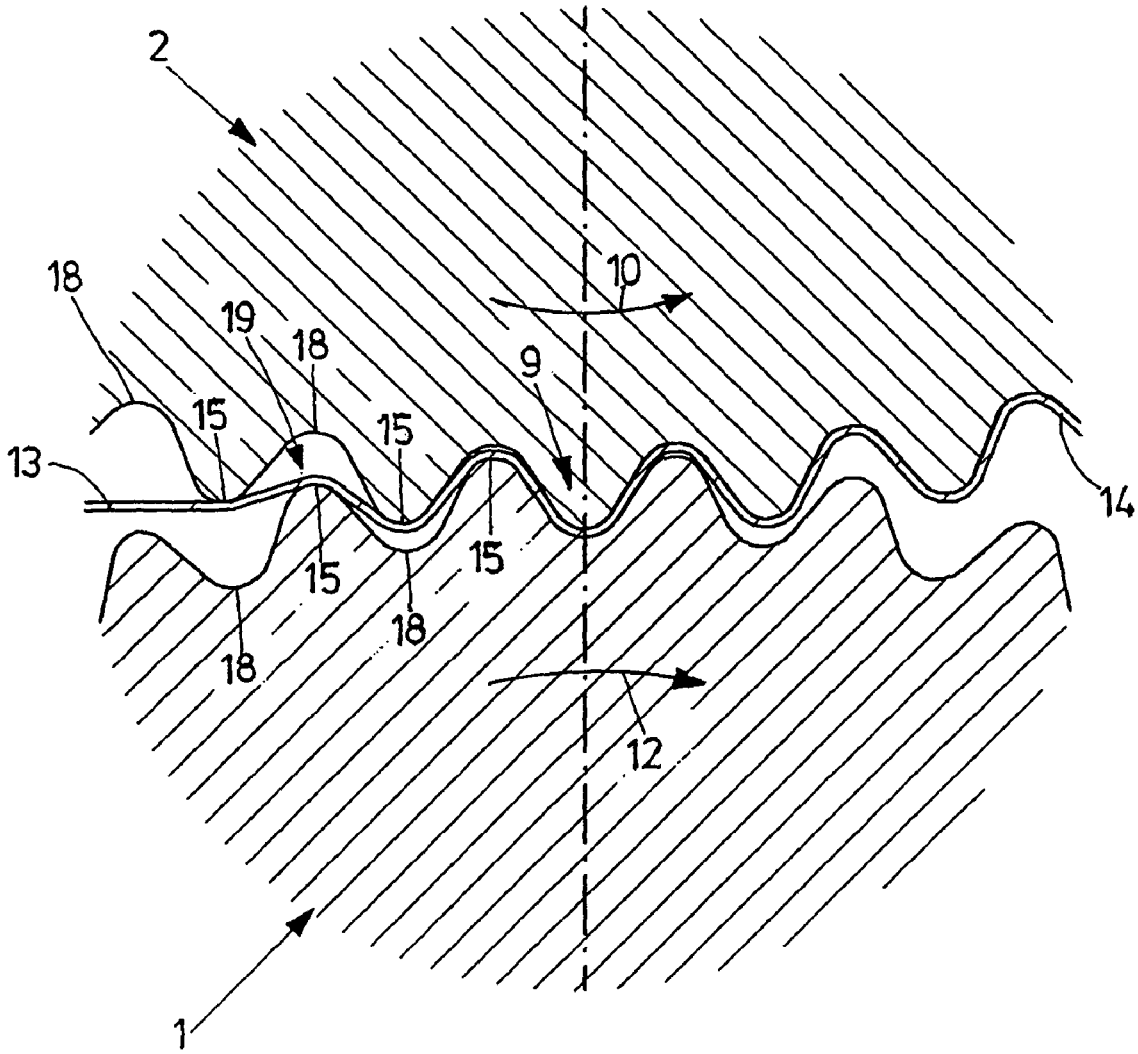
FIG. 3 is a detailed view, on an enlarged scale, of the contact area of the fluted rolls according to FIG. 2.

A detailed examination by the inventors of the infeed behaviour of a paper web 13 in the area 9 of contact between the fluted rolls 1, 2 has shown that the fluting heads 15 in the infeed area 19 seen on the left in FIG. 3 substantially determine the infeed behaviour. Prior to being pressed into the shape of a corrugated medium 14 in the contact area 9, the paper sheet 13 is tautened in the infeed area 19 between the meshing fluting heads 15 of the upper and lower fluted roll 2, 1 without the paper sheet 13 coming into contact with the roots 18 in the infeed area 19. Consequently, the infeed behaviour of the paper sheet 13 over the width of the fluted rolls 1, 2 depends substantially on the correct design of the fluting heads 15 in accordance with the ideal course described in FIG. 5, and rather not on the design of the roots 18 of the two fluted rolls 1 and 2 i.e., even in the case of a bomb-shaped fluted roll 1.

Figure 6:
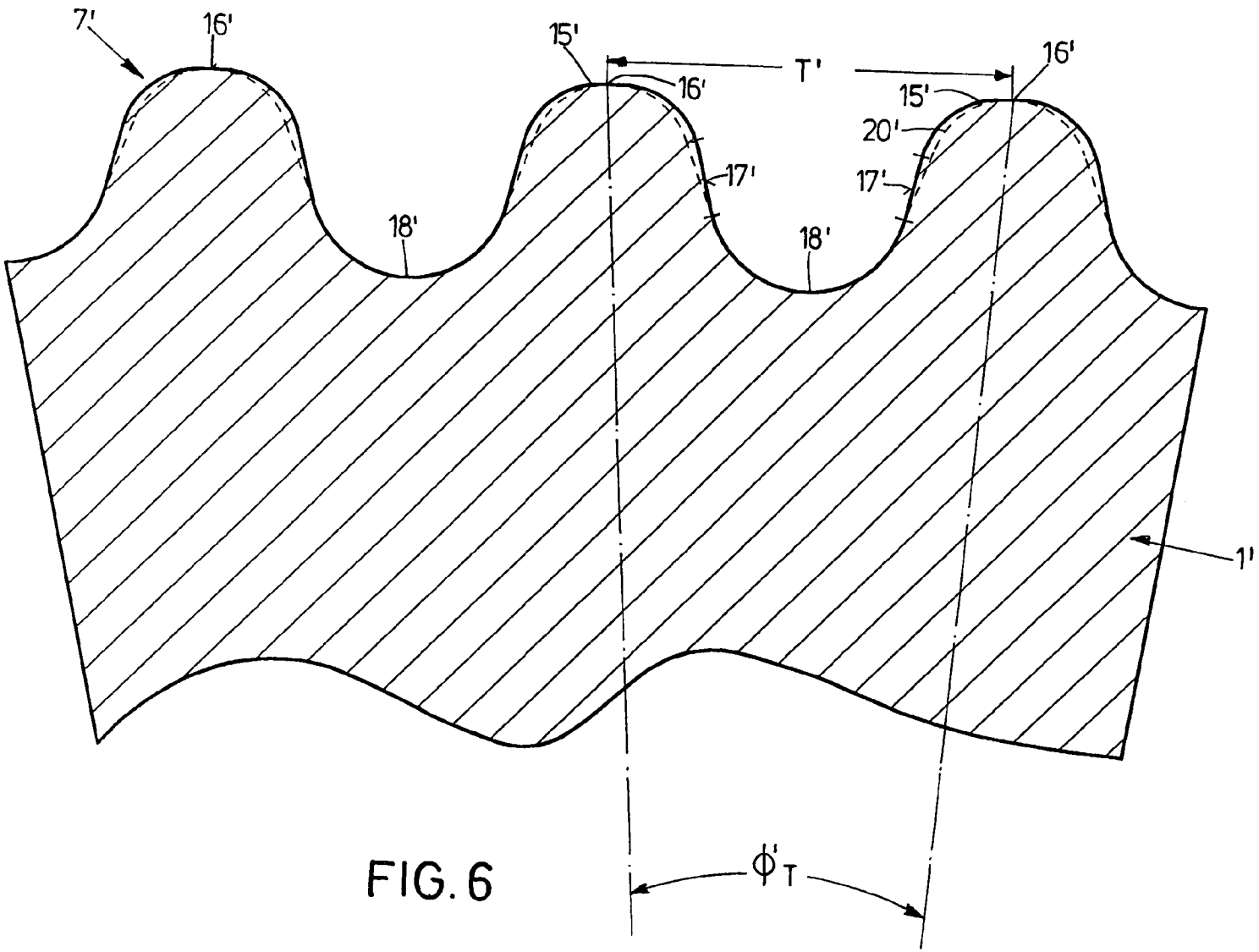
FIG. 6 is a detailed view, on an enlarged scale, of a section through a prior art bomb shaped fluted roll.

FIG. 6 illustrates a cross sectional view of the middle of a prior art bomb-shaped fluted roll. The reference numerals in FIG. 6 only serve for identification of parts of identical function as compared to the corrugating machine according to the invention described in conjunction with FIGS. 1 to 5. In indication of the fact that it shows a prior art fluted roll, FIG. 6 uses the same reference numerals for functionally identical parts as in the embodiment according to the invention, however provided with a prime. The solid line along the upper end of the fluted roll 1' in FIG. 6 shows the factual outer contour of the flutings 7' in the vicinity of the middle of a bomb-shaped fluted roll 1'. The dashed line shows the ideal course 20' of the flutings according to FIG. 5. The roots 18' correspond to the ideal course according to FIG. 5 even in the middle of the fluted roll 1' i.e., in the area of maximum diameter. However, the heads 15' are too wide, as illustrated by their deviation from the dashed line that shows the ideal course 20'. This is due to the prior art grinding method used. The prior art method uses a rotating grinding wheel with an annular bead which stands out radially and the outer contour of which corresponds to the contour of the root 18' that is to be ground. The rim that stands back on both sides of the annular bead grinds the flanks 17' and half heads 15' that adjoin the root 18' that is to be ground. Then the fluted roll that is to be ground is rotated by a given angular pitch $\phi'_T$ and the same process is repeated. Owing to the swell of the fluted roll 1', the circumference in the middle of the fluted roll 1' exceeds the circumference at the ends by for example 12.6 mm—as explained in the example mentioned at the outset—for each fluting head 15' resulting in a widening of 12.6 mm divided by the number of flutings 7'. The spacing T' i.e., the distance between neighboring crests 16' in the middle of the bomb-shaped fluted roll 1' is greater than at the two marginal areas. This is the reason for the widening of the fluting heads 15' in the prior art grinding method. Since the heads of the lower fluted roll do not precisely match the heads of the upper fluted roll throughout the width of the fluted roll, irregular infeed behaviour of the paper sheet 13' results in the infeed area 19, leading to creases, which has a lasting negative effect on the quality of the corrugated board produced.

Figure 7:
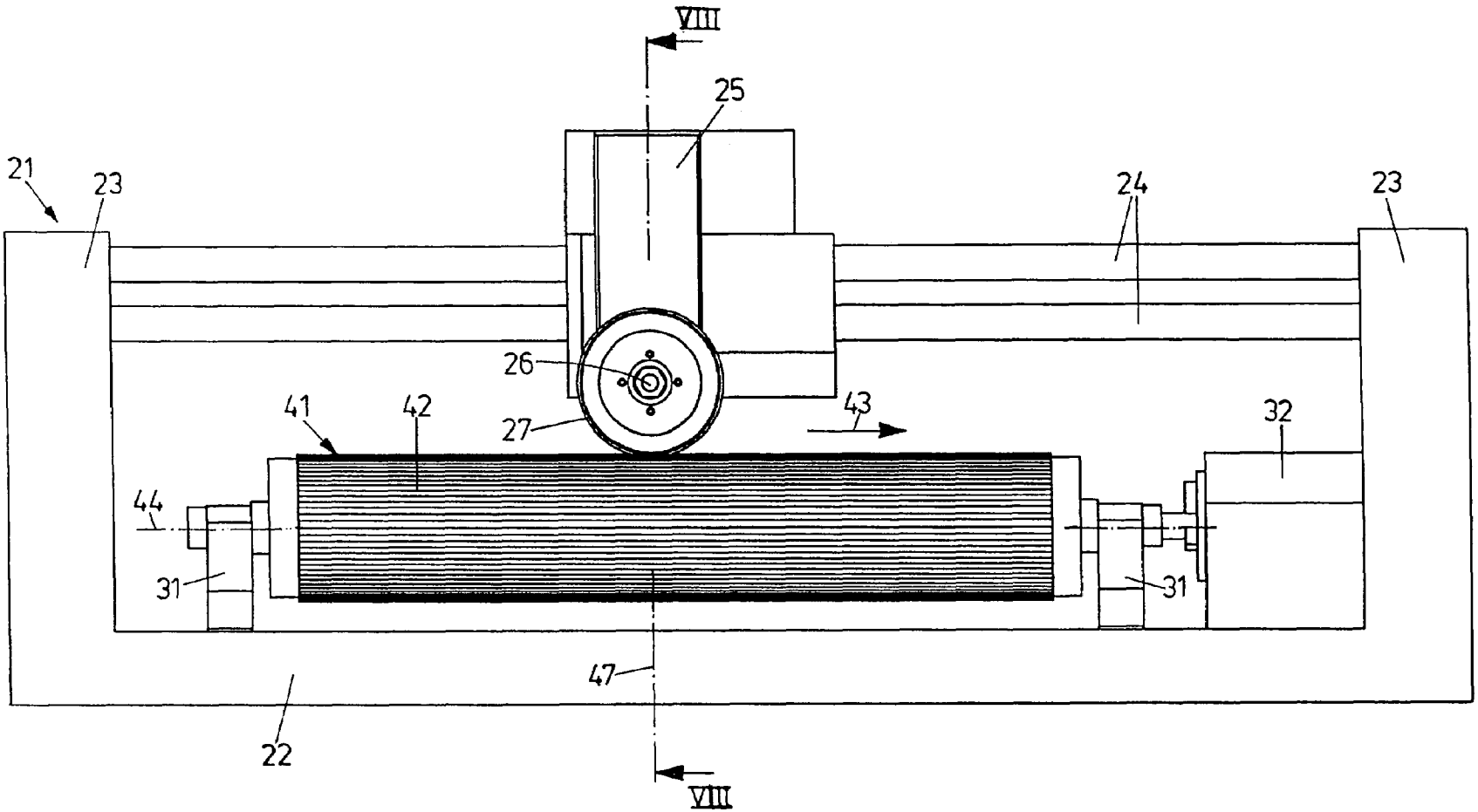
FIG. 7 is an illustration of a grinding device for grinding fluted rolls.
Figure 8:
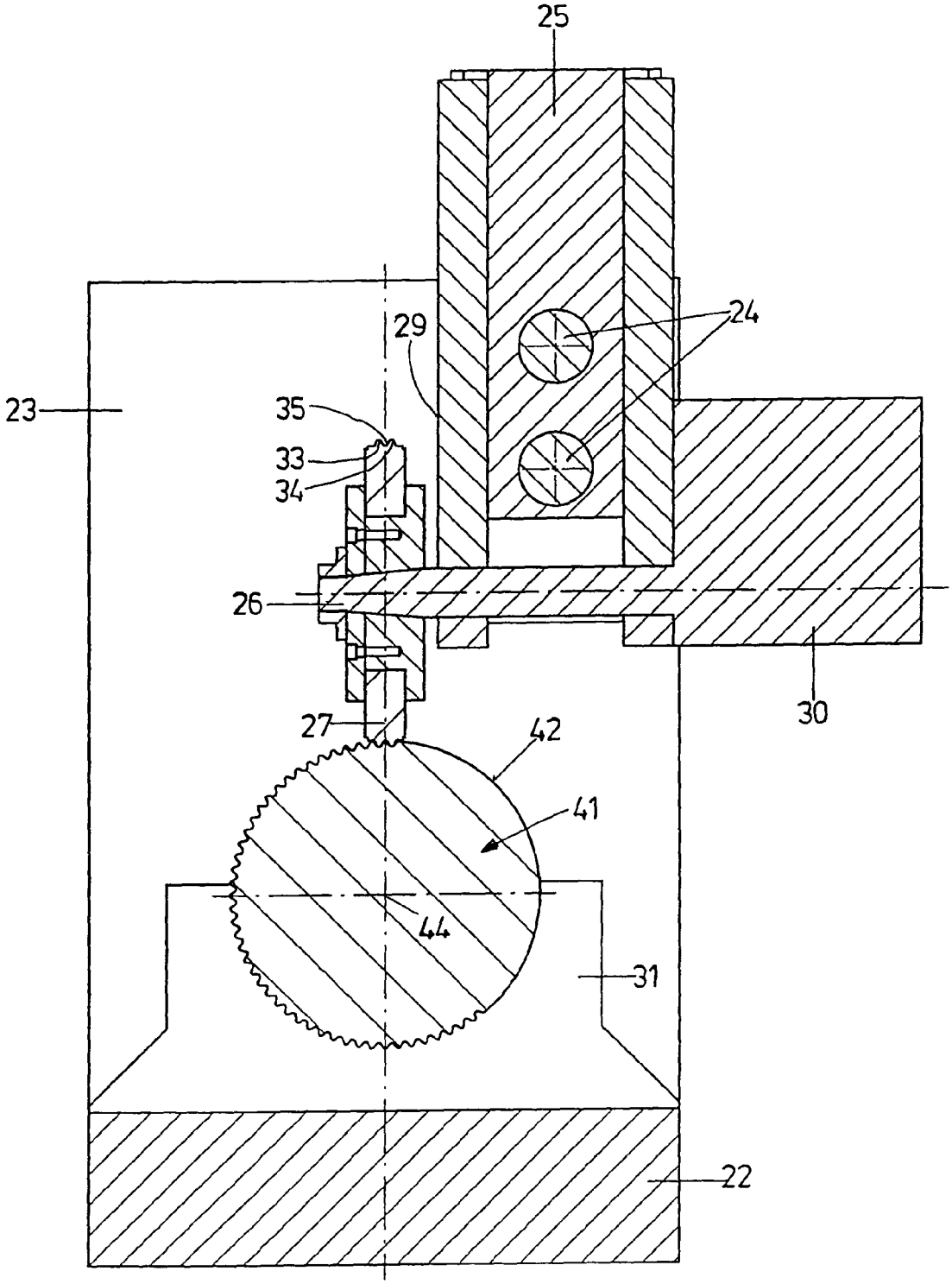
FIG. 8 is a cross-sectional view on the line VIII—VIII of FIG. 7.

A fluted-roll-grinding method according to the invention is going to be explained below, taken in conjunction with FIGS. 7 to 9.

A grinding device 21 comprises a machine frame 22 with two opposite vertical columns 23 between which are fixed two parallel motion rods 24. A skid 25 is displaceably guided on the motion rods 24. The skid 25 is driven for displacement on the motion rods 24 for instance by a spindle drive if the motion rods 24 are designed correspondingly, or by a rack and pinion drive in case the motion rods 24 are designed correspondingly. Fastened to the skid 25 is a rotarily mounted grinding wheel 27 which is provided with a shaft 26. The grinding wheel 27 is mounted for height adjustment in corresponding lateral guides 29 so that the contact pressure of the grinding wheel 27 against an object to be ground is constant upon displacement of the skid 25 on the motion rods 24. The grinding wheel 27 is actuated in rotation by a drive 30 which is illustrated diagrammatically. Two bearing blocks 31 are arranged underneath the motion rods 24 on the machine frame 22; a blank 41, to be ground, of a fluted roll is rotarily mounted between the blocks 31. By means of a drive 32 cooperating with the blank 41, the blank 41 can be rotated by constant angular pitches $\phi_T$.

Figure 9:
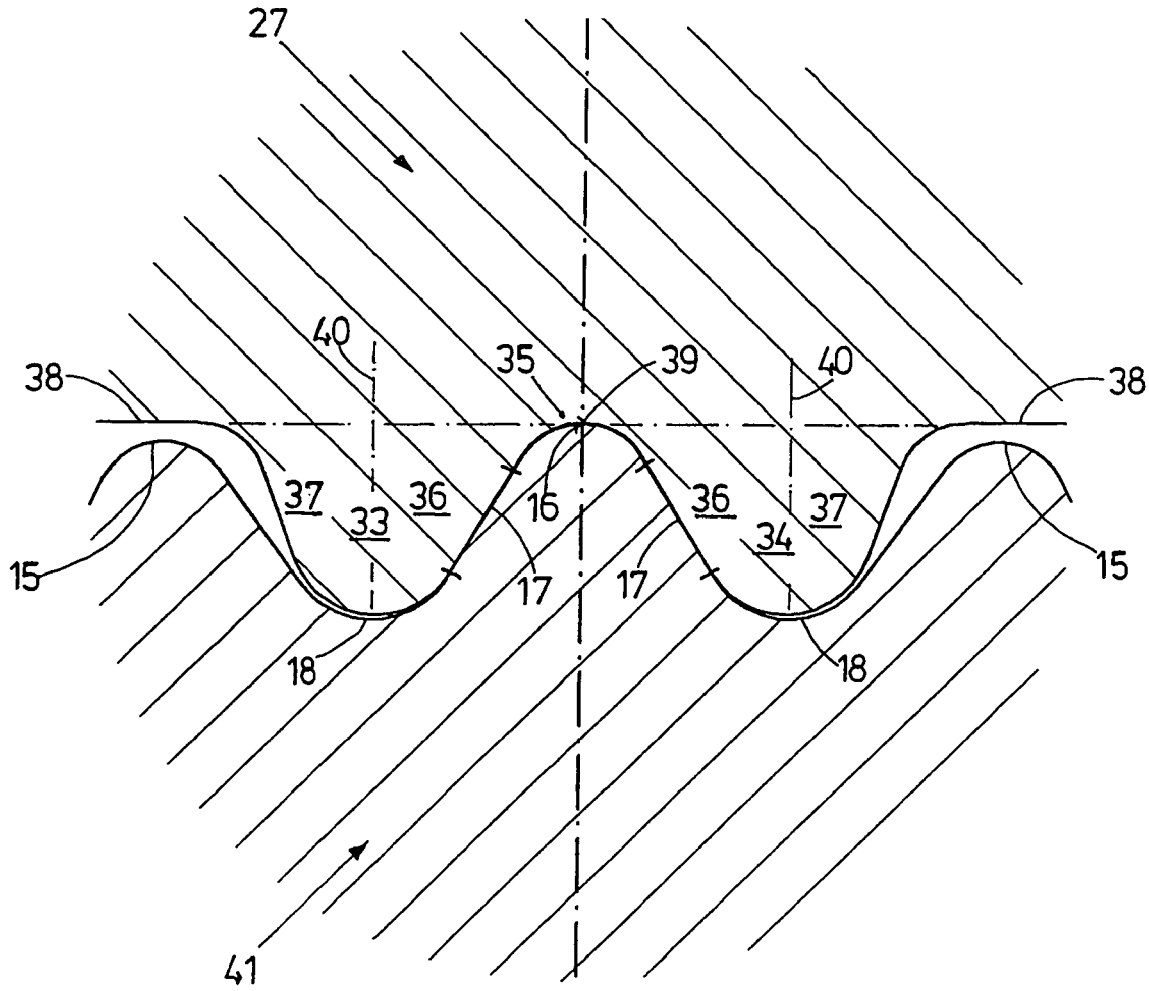
FIG. 9 is a detailed view, on an enlarged scale, of the contact area between the grinding wheel and the blank of a fluted roll according to FIG. 8.

As seen on an enlarged scale in FIG. 9, the grinding wheel 27 has two parallel annular beads 33, 34 which project radially related to the shaft 26 and between which is formed an annular recess 35 that stands back radially related to the beads 33, 34. Related to the circumferential line of maximum distance from the shaft 26, the annular beads 33 and 34 are composed of halves 36 that are turned towards the recess 35 and of halves 37 that face away therefrom. The recess 35 and the adjoining halves 36 precisely correspond to the negative contour of an ideal fluting 7, 8 seen in FIG. 5, i.e. a fluting head 15, the two adjacent flanks 17 and half a root 18. The two outer halves 37 of the grinding wheel 27 pass into external cylindrical portions 38, the distance of which from the shaft 26 being equal to, or preferably slightly less than, the distance of the point 39 of maximum depth of the recess 35. The outer contour of the half 37 is slightly narrower than the outer contour of the half 36 so that the two halves 36 and 37 are not mirror symmetrical in relation to the median line 40.

In the grinding method according to the invention, a blank 41 is clamped between the bearing blocks 31. Depending on the height H of the flutings that are to be ground i.e., on the difference in radius between a crest 16 and the trough of an adjacent root 18, use is made of blanks of a smooth, non-structured surface 42 or of blanks 41 that are roughly fluted. The blank 41 may be bomb-shaped. In the actual grinding process, the rotating grinding wheel 27 is lowered on to the blank 41 and moved along the blank 41 in a longitudinal direction 43 that is parallel to the central longitudinal axis 44 of the blank 41. If the blank 41 has a swell, the grinding wheel 27 is moved upwards on the guide 29. Due to the design, described above, of the grinding wheel 27, a fluting head 15 and associated flanks 17 and parts of the adjacent roots 18 are ground over the entire width of the fluted roll during a grinding process, corresponding in shape to the ideal fluting seen in FIG. 5. FIG. 8 shows a grinding process in which a blank 41 is ground that has a smooth surface 42. The enlarged detailed view of FIG. 9 illustrates a grinding job of a blank 41 that has a roughly fluted surface 42, which is why fluting heads 15 are available to the left as well as to the right of the grinding wheel 27. Once a head 15 has been ground, the grinding wheel 27 is lifted and retracted and the blank 41 is rotated by the angular pitch $\phi_T$. Subsequently, another fluting is ground until the entire surface 42 is regularly fluted.

The grinding method according to the invention also offers important advantages regarding the wear of the grinding wheel 27 during a grinding job. In the case of a prior art grinding wheel that has an annular bead for grinding a root, the annular bead of the grinding wheel will become more and more pointed, most of the wear taking place in the vicinity of the flank. Upon subsequent renewed fitting of the grinding wheel, the entire material in the marginal area of the annular bead must be removed for an annular bead to be produced that will again correspond to the shape of a root. In the grinding wheel 27 according to the invention, the annular beads 33, 34 are largely maintained, because most of the wear takes place in the vicinity of the flanks of the annular recess 35, the grinding wheel thus redessing itself to a certain extent. In particular in the case of roughly fluted blanks, self-centering of the grinding wheel 27 takes place on the rough fluting.

Figure 10:
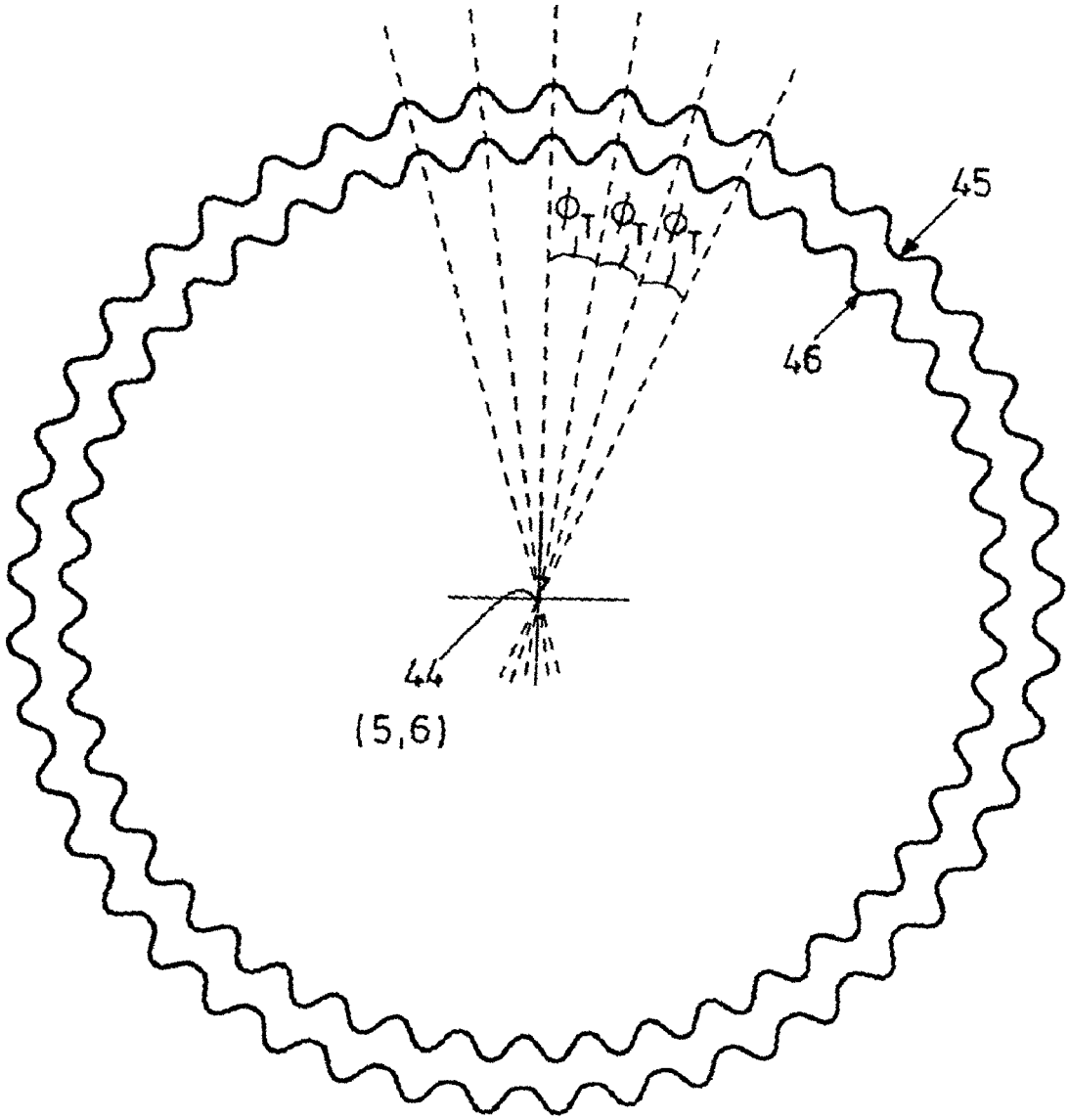
FIG. 10 is a cross-sectional view through the middle of a fluted roll ground according to the invention.
Figure 11:
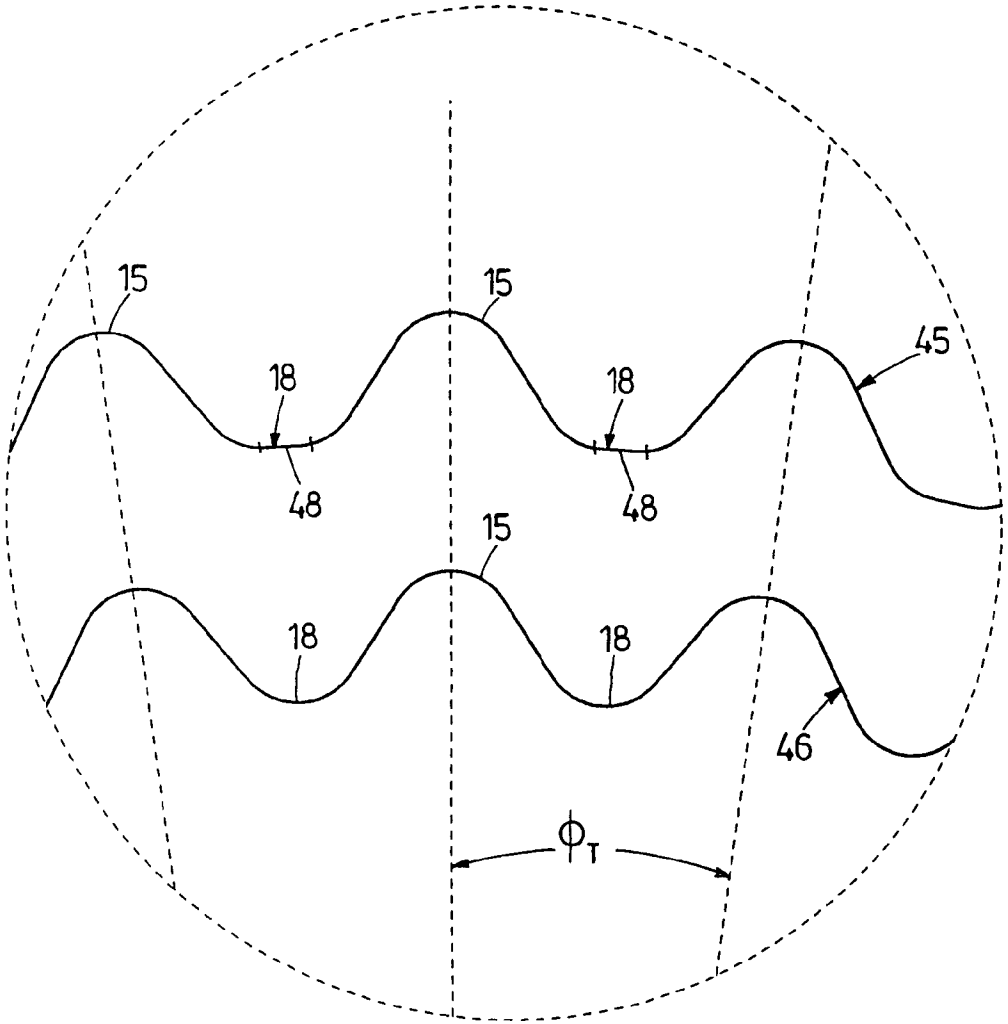
FIG. 11 is a detailed view, on an enlarged scale, of the flutings of the fluted roll according to FIG. 10.

In conjunction with FIGS. 10 to 12, the result of a grinding method according to the invention will be explained below, based on the use of a bomb-shaped fluted roll. FIG. 10 shows a section, vertical to the central longitudinal axis 44, of a finished, bomb-shaped fluted roll, the outer serration 45 representing the serration in the vicinity of the middle of the fluted roll. The inner serration 46 that is plotted corresponds to the serration at one of the ends of the fluted roll being projected along the central longitudinal axis 44 on the cutting plane 47. The enlarged detailed view of FIG. 11 shows that the fluting heads 15 of the outer serration seen in FIG. 11 i.e., in the area of maximum swell, and of the inner serration 46 i.e., in the marginal area of the fluted roll, are of identical design, having respective crests 16 that define a common plane together with the central longitudinal axis 44. In this regard, the infeed behaviour of a paper sheet 13 seen in FIG. 3, which is dominated by the fluting heads 15, is uniform throughout the width of the fluted roll, there being no creasing. The roots 18 of the inner serration 46 illustrated are also of ideal design, corresponding to the illustration of FIG. 5. The roots 18 of the outer serration 45 have a flattened center portion 48, the width of which corresponding to the difference in circumference due to the swell, which is 12.6 mm divided by the number of flutings in the example. In this regard, the roots 18 of the outer serration 45 do not correspond to the ideal course according to FIG. 5. However, this is of no importance for the feed behaviour of a paper sheet 13, the infeed being determined, as explained, by the fluting heads 15.

Figure 12:
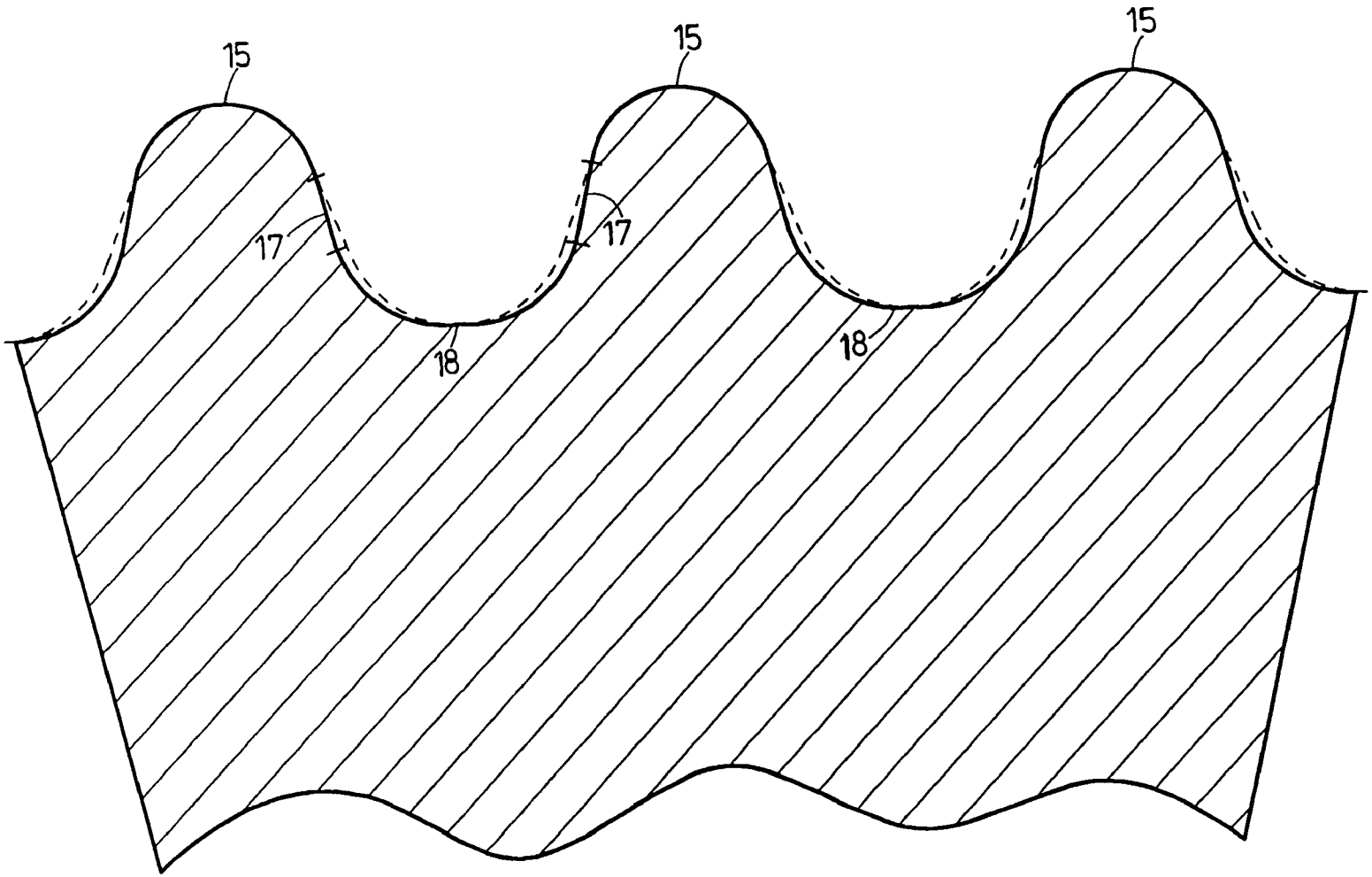
FIG. 12 is a detailed view, on an enlarged scale, of a cross-section of the middle of a fluted roll, ground according to the invention, in the vicinity of maximum swell.

FIG. 12 illustrates a section, on the cutting plane 47, of a ground fluted roll according to the invention, for instance the fluted roll 1. The section permits a comparison with the fluted roll seen in FIG. 6 that has been ground according to the prior art grinding method. The solid top line shows the factual course of the fluting. The dashed line shows the ideal course, deviations from which are found in the area of maximum swell. The fluting heads 15 correspond to the ideal course, the roots 18 are comparatively too wide. This is also true for the lower part of the flanks 17.

The swell as well as deviations from the ideal shape produced by the different grinding methods are not true to scale in any of the drawings.

What is claimed is:

1. A method for the manufacture of fluted rolls, in particular for corrugating machines, comprising the following steps:

providing a fluted-roll blank (41) with a central longitudinal axis (44) and with a longitudinal direction (43) that is parallel thereto and with a surface (42);

wherein the fluted-roll blank (41) has a swell;

providing a grinding device (21) for grinding, on the surface (42), flutings (7, 8) that run in the longitudinal direction (43);

the flutings (7, 8) comprising fluting heads (15) and roots (18) that are parallel to each other and are regularly and alternately distributed along the circumference of the surface (42); and grinding fluting heads (15) on the surface (42) by means of the grinding device (21), the fluting heads (15) having the same cross-sectional curvature in the longitudinal direction (43).

2. A method according to claim 1, wherein the fluted-roll blank (41) has a diameter that varies in the longitudinal direction (43).

3. A method according to claim 1, wherein a grinding wheel (27) that is displaceable in the longitudinal direction (43) is used in the grinding device (21).

4. A method according to claim 3, wherein a grinding wheel (27) is used, having two radially projecting annular beads (33, 34) and an annular recess (35) that is disposed there-between and stands back radially.

5. A method according to claim 4, wherein the annular recess (35) corresponds in cross-sectional shape to the curvature of the fluting heads (15).

6. A method according to claim 3, wherein the grinding wheel (27), upon grinding, is set to the surface (42) of the fluted-roll blank (41).

7. A method according to claim 1, wherein the grinding device (21), upon grinding of the fluting heads (15), grinds a part of the two roots (18) that adjoin the heads (15).

8. A method for the manufacture of fluted rolls, in particular for corrugating machines, comprising the following steps:

providing a fluted-roll blank (41) with a central longitudinal axis (44) and with a longitudinal direction (43) that is parallel thereto and with a surface (42);

wherein the fluted-roll blank (41) has a swell;

providing a grinding device (21) for grinding, on the surface (42), flutings (7, 8) that run in the longitudinal direction (43);

wherein a grinding wheel (27) that is displaceable in the longitudinal direction (43) is used in the grinding device (21); and the flutings (7, 8) comprising fluting heads (15) and roots (18) that are parallel to each other and are regularly and alternately distributed along the circumference of the surface (42); and grinding fluting heads (15) on the surface (42) by means of the grinding device (21), wherein the rotating grinding wheel (27) is moved along the fluted-roll blank (41) and upwards on a guide (29) for height adjustment; and the fluting heads (15) having the same cross-sectional curvature in the longitudinal direction (43).

9. A method according to claim 8, wherein the fluted-roll blank (41) has a diameter that varies in the longitudinal direction (43).

10. A method according to claim 8, wherein a grinding wheel (27) is used, having two radially projecting annular beads (33, 34) and an annular recess (35) that is disposed there-between and stands back radially.

11. A method according to claim 10, wherein the annular recess (35) corresponds in cross-sectional shape to the curvature of the fluting heads (15).

12. A method according to claim 8, wherein the grinding wheel (27), upon grinding, is set to the surface (42) of the fluted-roll blank (41).

13. A method according to claim 8, wherein the grinding device (21), upon grinding of the fluting heads (15), grinds a part of the two roots (18) that adjoin the heads (15).

14. A method for the manufacture of fluted rolls, in particular for corrugating machines, comprising the following steps:

providing a fluted-roll blank (41) with a central longitudinal axis (44) and with a longitudinal direction (43) that is parallel thereto and with a surface (42);

wherein the fluted-roll blank (41) has a swell;

providing a grinding device (21) for grinding, on the surface (42), flutings (7, 8) that run in the longitudinal direction (43);

wherein a grinding wheel (27) that is displaceable in the longitudinal direction (43) is used in the grinding device (21);

wherein the used grinding wheel (27) has two radially projecting annular beads (33, 34) and an annular recess (35) that is disposed there-between and stands back radially; and the flutings (7, 8) comprising fluting heads (15) and roots (18) that are parallel to each other and are regularly and alternately distributed along the circumference of the surface (42); and grinding fluting heads (15) on the surface (42) by means of the grinding device (21), the fluting heads (15) having the same cross-sectional curvature in the longitudinal direction (43).

15. A method according to claim 14, wherein the fluted-roll blank (41) has a diameter that varies in the longitudinal direction (43).

16. A method according to claim 14, wherein the annular recess (35) corresponds in cross-sectional shape to the curvature of the fluting heads (15).

17. A method according to claim 14, wherein the grinding wheel (27), upon grinding, is set to the surface (42) of the fluted-roll blank (41).

18. A method according to claim 14, wherein the grinding device (21), upon grinding of the fluting heads (15), grinds a part of the two roots (18) that adjoin the heads (15).

* * * * *